United States Patent [19]

Bennett

[11] Patent Number: 4,686,806

[45] Date of Patent: Aug. 18, 1987

[54] MOLDED HIGH IMPACT INDUSTRIAL DOOR

[75] Inventor: Mark A. Bennett, Milwaukee, Wis.

[73] Assignee: Kelley Company Inc., Milwaukee, Wis.

[21] Appl. No.: 826,761

[22] Filed: Feb. 6, 1986

[51] Int. Cl.[4] ..... E04C 1/00

[52] U.S. Cl. ..... 52/309.4; 52/806; 52/808

[58] Field of Search ..... 52/309.4, 404, 794, 52/806, 808, 809; 49/490, 498; 438/117, 178, 256

[56] References Cited

U.S. PATENT DOCUMENTS

| | | | |
|---|---|---|---|
| 3,025,935 | 3/1962 | Ensrud et al. | 52/808 X |
| 3,344,574 | 10/1967 | Palfey | 52/404 X |
| 3,407,536 | 10/1968 | Nystrom | 49/498 X |
| 3,771,495 | 11/1973 | Stevenson et al. | 52/309.4 X |
| 3,802,145 | 4/1974 | Scanlon | 52/404 X |
| 4,084,367 | 4/1978 | Saylor et al. | 52/809 X |
| 4,227,356 | 10/1980 | Stern et al. | 52/309.4 X |
| 4,433,021 | 2/1984 | Riel | 52/806 X |
| 4,557,961 | 12/1985 | Gorges | 52/806 X |

FOREIGN PATENT DOCUMENTS

| | | | |
|---|---|---|---|
| 545469 | 8/1957 | Canada | 52/806 |

OTHER PUBLICATIONS

Durus Industries "Energy Saving Doors".
Frommelt Series 4000.
McGuire, "The New Tuf-Dor 200".
Frommelt "Traffic Door Product Guide".
Flexion Inc., "Flexidoor Series ID-Full Thickness Traffic Door".
Rubbair Door, "Double Acting Impact Traffic Doors".

*Primary Examiner*—William F. Pate, III
*Assistant Examiner*—Creighton Smith
*Attorney, Agent, or Firm*—Andrus, Sceales, Starke & Sawall

[57] ABSTRACT

A molded, high impact, industrial door having a thermoplastic resin honeycomb core formed with a multiplicity of cells. Each cell has an open end and side walls that converge to a closed bottom and alternate cells open to opposite faces of the core. The cells are filled with a lightweight resilient flexible filler material, such as foam resin, and the core is encapsulated in an elastomeric resin. The molded door is abrasion and corrosion resistant and is capable of withstanding the high impact forces of material handling equipment.

16 Claims, 5 Drawing Figures

FIG. 2
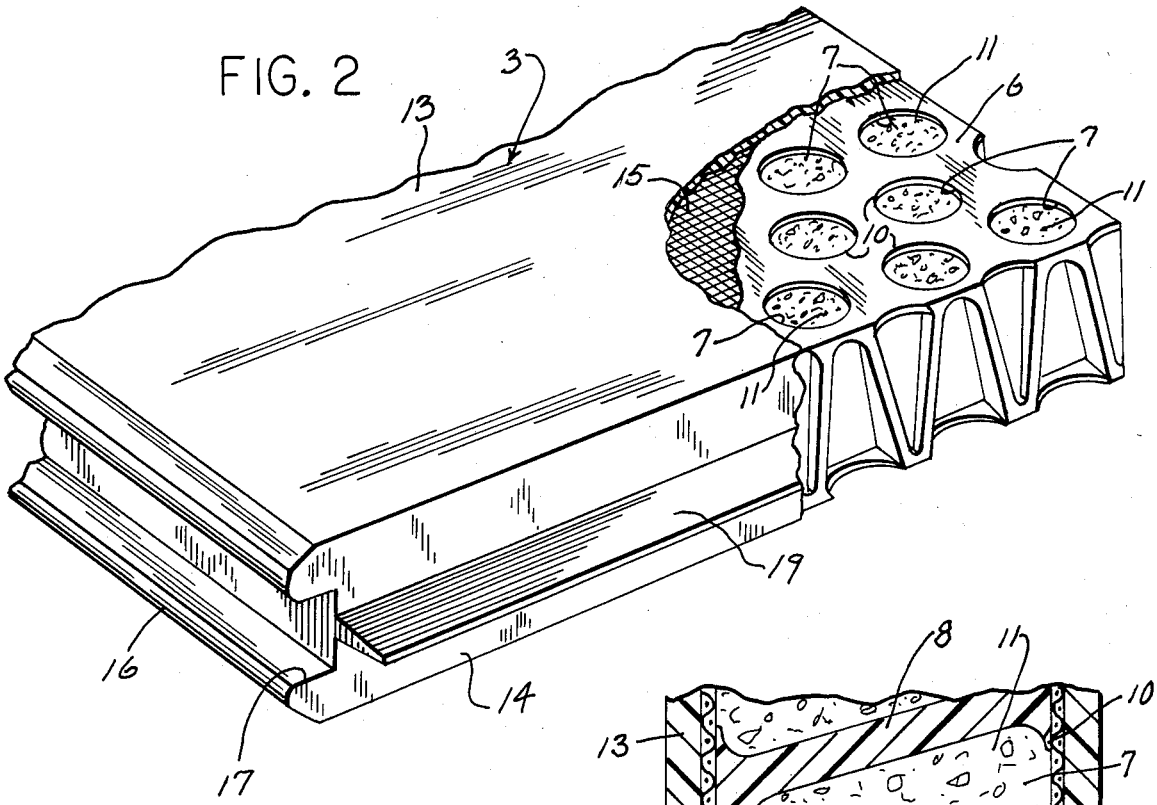
FIG. 3
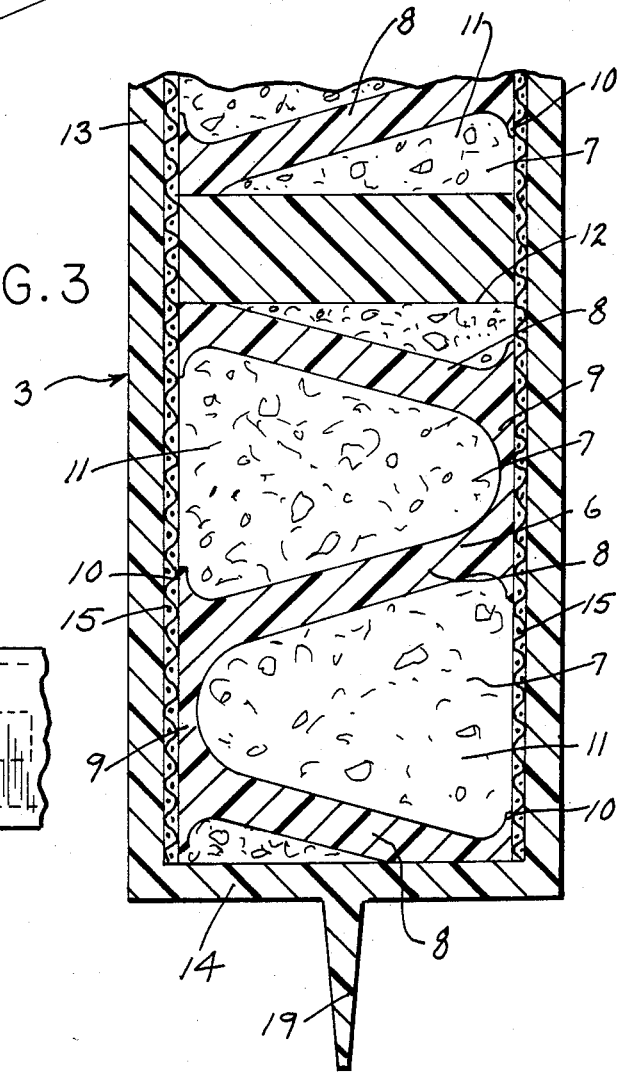
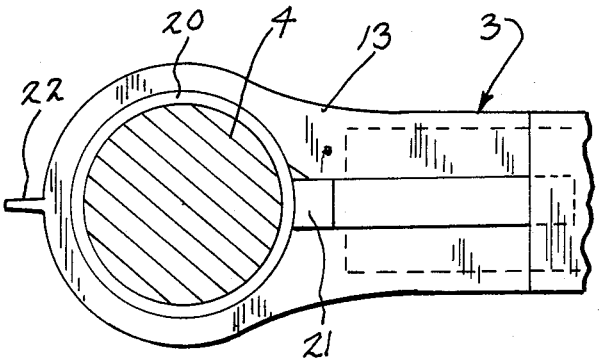
FIG. 5

MOLDED HIGH IMPACT INDUSTRIAL DOOR

BACKGROUND OF THE INVENTION

Industrial swinging doors are adapted to enclose doorways in industrial or commercial facilities and are normally intended to be opened by the impact of moving material handling equipment, such as fork lift trucks. As the door is subjected to considerable impact by the material handling equipment, the doors should be lightweight, as well as impact and abrasion resistant.

In the past, industrial doors have been composed of a structural steel or rubber frame with abrasion resistant plastic or rubber facing sheets connected to the frame. However, doors of this type are of a relatively heavy and expensive construction and are prone to delamination.

Industrial doors constructed primarily of plastic and/or rubber materials tend to warp significantly in applications where a temperature differential exists, such as in freezer or cooler applications, due to their high coefficient of thermal expansion.

U.S. Pat. No. 4,084,347 discloses an industrial door formed of lightweight plastic materials. As is disclosed in this patent, the door is composed of a hollow body of a moldable plastic material and the interior of the body is filled with an insulating material, such as foam plastics, or the like. In addition, the industrial door of the aforementioned patent includes a plurality of reinforcing rods which are embedded within the insulating material and extend the height of the door.

In the past, honeycomb panels formed of paper or thermoplstic resin have been used in the manufacture of residential doors and furniture. In products of this type, facing sheets of plywood, metal foil, plastic and the like are bonded to opposite faces of the honeycomb core. However, constructions of this type are not satisfactory for high impact applications, such as industrial doors.

SUMMARY OF THE INVENTION

The invention is directed to a lightweight, impact resistant, industrial door. In accordance with the invention, the door is formed of a thermoplastic resin, honeycomb core having a multiplicity of cells. Each cell has an open end and the side walls of the cells converge to a closed narrow bottom. Alternate cells open to opposite faces of the core.

The cells are filled with a lightweight, flexible, resilient material, such as foam resin, and the filled core is encapsulated in a molded elastomeric resin which bonds to the exposed faces of the core, as well as to the filler material exposed in the open ends of the cells.

In certain areas of the door, holes can be provided in the filled honeycomb core and the elastomeric material extends through the holes to provide for an added mechanical interlock between the opposing molded faces of the door.

The industrial door of the invention is of lightweight construction and is capable of withstanding high impact forces generated by material handling equipment, without the need of any auxiliary reinforcement.

Due to its plastic construction, the door is highly resistant to abrasion, puncturing or denting and will retain its attractive appearance over extended periods of service life.

As the door is formed solely of plastic materials, it is corrosion resistant, and due to the smooth outer molded facing, it can be readily cleaned.

The filler material, such as foam plastic, adds insulating qualities to the door, so that the door has particular use in cold storage warehouses, or other facilities where it is desired to insulate one zone from another. In order to prevent thermal deformation of the door in such an application, a reinforcing mesh, of metal or glass fiber, can be molded in place at the interfaces of the core and the encapsulating elastomer.

As the door is of lightweight construction, it can be readily transported and installed.

The thermoplastic resin core, as well as the filler material and encapsulating material are flexible and resilient materials, so that the door is capable of flexing under impact without permanent deformation or denting.

Other objects and advantages will appear in the course of the following description.

DESCRIPTION OF THE DRAWINGS

The drawings illustrate the best mode presently contemplated of carrying out the invention.

In the drawings:

FIG. 2 is a fragmentary perspective view with parts broken away showing the door construction;

FIG. 3 is a transverse section of the door taken along line 3—3 of FIG. 1;

FIG. 5 is a section taken along line 5—5 of FIG. 1.

DESCRIPTION OF THE ILLUSTRATED EMBODIMENT

Figure 1:
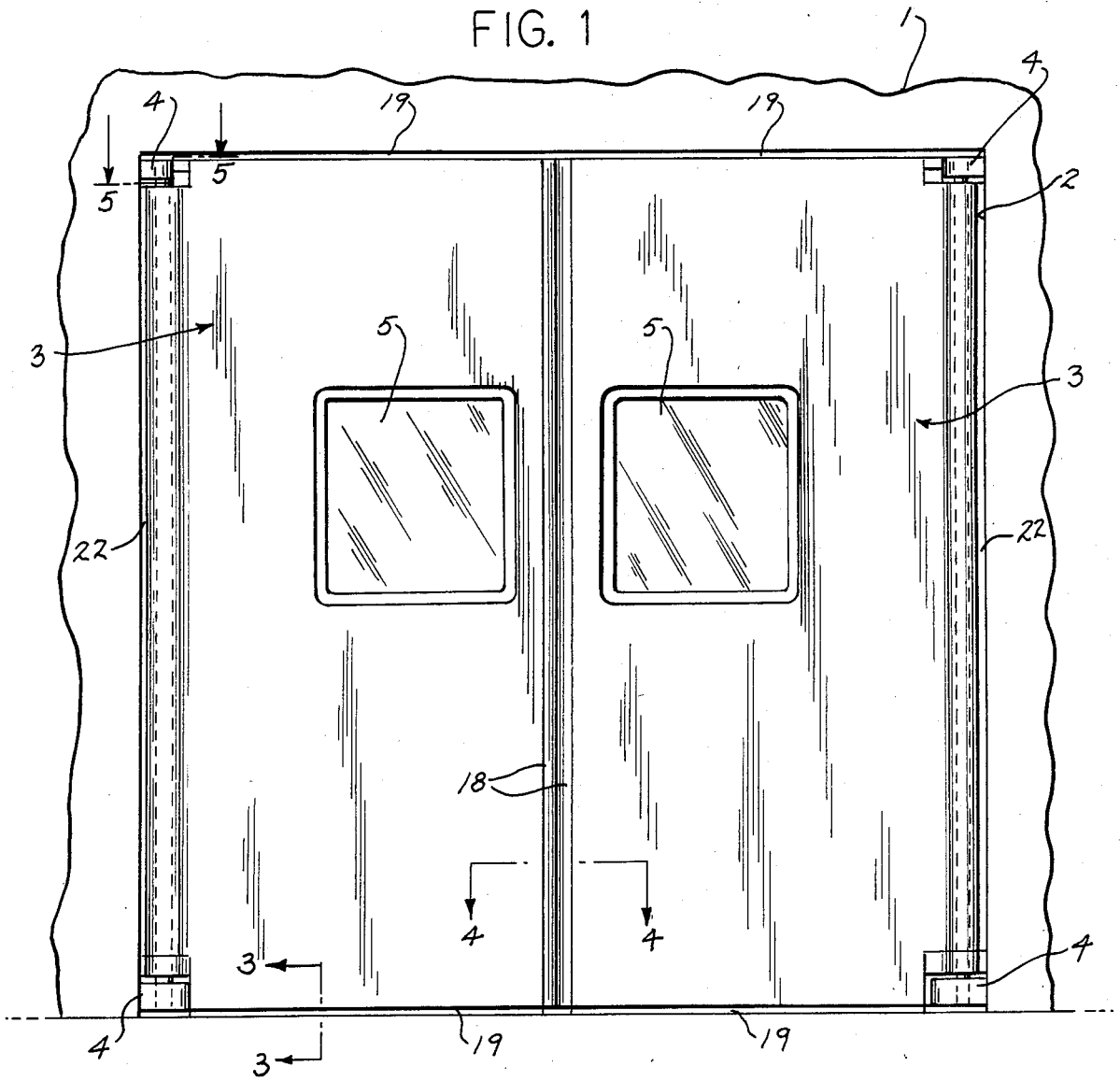
FIG. 1 is a front elevation of the industrial doors of the invention, as mounted in a building.

FIG. 1 illustrates a building 1, or other facility, having a doorway 2 which is enclosed by a pair of swinging industrial doors 3. Doors 3 are each hinged to the building 1 through hinge and spring loaded closing mechanisms 4 of a conventional type, which permit the doors to be swung in both directions under impact by material handling equipment, such as a fork lift truck, and returned to the closed position.

As shown in FIG. 1, each door can be provided with one or more windows 5, so that an operator of material handling equipment can observe traffic on the opposite side of the door.

As best illustrated in FIGS. 2 and 3, the door includes a honeycomb core 6 formed of a thermoplastic resin, such as polypropylene, polyethylene, or polycarbonate. The core 6 has a multiplicity of cells 7, and each cell is bordered by a sloping side wall 8 which terminates in a generally rounded bottom 9. As best shown in FIG. 3, alternate cells 7 open to opposite faces of the core 6 and the open end of each cell is bordered by a thin annular lip 10.

As shown in FIG. 3, a filler material 11 is bonded within the cells 7. The filler material 11 is a lightweight, resilient, flexible material, such as foam plastic or rubber, plastic spheres, or the like. It has been found that foam polyurethane resin is a suitable material for the filler 11.

Figure 4:
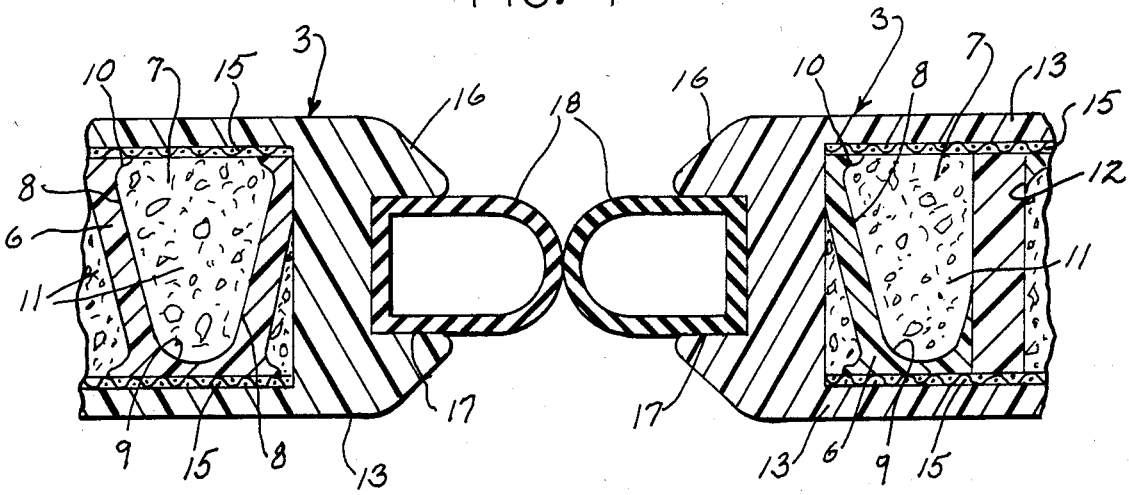
FIG. 4 is a transverse section of the door showing the mounting of the vertical edge strips.

In certain areas of the door, particularly in areas which may be subjected to high impact by material handling equipment, holes 12 can be formed through the filled core and communicate with the opposite faces of the core. As shown in FIG. 3, holes 12 can be concentric with cells 7, or the holes 12 can be in a random pattern, and offset from the axes of the cells, as shown in FIG. 4. The holes 12 are drilled after the cells 7 are filled with the material 11, and thus can cut through the walls 8 of the cells.

An encapsulating material 13 is bonded to the core 6, as well as to the exposed filler material 11 in cells 7, as illustrated in FIG. 3. The encapsulating material 13 also extends around the edges of the door, as indicated by 14, to completely encapsulate core 6. Encapsulating material 13 is preferably formed of an elastomericic resin, such as polyurethane resin, and it is preferred that the encapsulating material 13 be compatible with the filler material 11, so that a firm bond can be obtained between the filler material in cells 7 and the encapsulating material 13.

To prevent thermal deformation in installations where the door is subjected to substantial temperature differentials, a layer 15 of reinforcing mesh, formed of a material such as metal or glass fiber, can be molded in place at the interfaces between core 6 and the encapsulating material 13, as shown in FIG. 3. During molding, the elastomeric material 13 will penetrate the openings in mesh 15.

As illustrated in FIG. 4, the inner vertical edge 16 of each door 3 is provided with a vertical recess 17 and a hollow rubber wiper strip 18 is secured within the recess either by adhesive bonding or mechanical fasteners. In the closed position of doors 3, wiper strips 18 are in contact to provide a weather seal at the joint between the doors.

In addition, wiper strips 19 can be integrally molded along the upper and lower encapsulating edges 14 of the door. FIG. 3 illustrates the lower wiper strip 14 that rides against the floor to provide a weather seal in that area. The upper wiper strip 19 is positioned to engage the door header.

It is also contemplated that hinge tubes 20 of hinge mechanisms 4 can be integrally molded with the encapsulating elastomer. As shown in FIG. 5, each hinge tube 20, as well as a striker plate 21 that is welded to the tube, is molded in the encapsulating material 13. In addition, the elastomeric material 13 can be molded to form a vertical wiper strip 22 that is adapted to engage the jamb of the door to provide a seal between the jamb and the side edges of the door.

In fabricating the door of the invention, a liquid resin, such as polyurethane foam, is poured over the core to fill the cells 7. After the resin has solidified, opposite faces of the molded product are sanded or roughened and holes 12 can be drilled in certain desired areas of the filled core 6.

Reinforcing sheets 15, if used, can be secured to opposite faces of the filled core, and the core 6 is then placed vertically within a mold and suitable spacers are connected to the core to space the faces and edges of the core from the mold. The liquid elastomeric resin is then introduced into the mold, and the resin passes through holes 12 and is integrally fused or bonded to filler material 11 and core 6 to provide the fully molded door construction.

The door is capable of withstanding the high impact forces of material handling equipment, without permanent deformation or denting.

The door is corrosion and abrasion resistant, has smooth outer sufaces which can be readily cleaned, and due to the insulating qualities provided by the filler material, has particular application for use in facilities where it is desired to maintain temperature differentials between different zones of the building.

Various modes of carrying out the invention are contemplated as being within the scope of the following claims particularly pointing out and distinctly claiming the subject matter which is regarded as the invention.

What is claimed is:

1. An impact resistant industrial door, comprising a honeycomb core formed of thermoplastic resin and having a pair of opposed faces and having edges connecting said faces, said core having a multiplicity of cells with each cell having an open end and having a closed bottom, the open ends of a first group of said cells being located on one face and the open ends of a second group of said cells being located on the opposite face, a lightweight resilient flexible material filling said cells and extending to said open ends, an elastomeric resin encapsulating said core and being bonded to said faces and said edges and to said material exposed in the open end of said cells, said core having a plurality of holes extending between said faces and intersecting said cells, and said elastomeric resin extending through said holes.

2. The door of claim 1, wherein said core is composed of a polyolefin resin and said material is polyurethane foam.

3. The door of claim 1, wherein each cell is bordered by a side wall sloping inwardly toward said bottom.

4. The door of claim 3, and including a lip disposed generally flush with one of said faces and extending inwardly partially across the open end of the corresponding cell.

5. The door of claim 1, and including a layer of foraminous material having a plurality of openings and disposed on at least one of said faces, said elastomeric material being disposed within said openings.

6. The door of claim 5, wherein said foraminous material is metal mesh.

7. An industrial door, comprising a honeycomb core formed of thermoplastic resin and having a pair of exposed faces and having side edges connecting said faces, said core composed of a multiplicity of cells with each cell having an open end and a closed bottom, the open ends of a first group of said cells being located on one of said faces while the open ends of a second group of said cells being located on said opposite face, a lightweight resilient flexible material bonded with and filling the cells and extending to said open ends, and a tough impact resistant plastic material molded around said core and being bonded to said faces and to said side edges and to said material exposed at the open ends of said cells, said core having a plurality of holes extending through said core from one face to the opposite face and intersecting said cells, said plastic material disposed within said holes.

8. The door of claim 7, wherein each cell is bordered by a side wall sloping inwardly toward said bottom and the open end of each cell is bordered by a thin inwardly extending lip.

9. An industrial door, comprising a honeycomb core formed of thermoplastic resin and having a pair of exposed faces and having side edges connecting said faces, said core composed of a multiplicity of cells with each cell having an open end and a closed bottom, the open ends of a first group of said cells being located on one of said faces while the open ends of a second group of said cells being located on said opposite face, said cells being disposed in a regular pattern throughout said core, a foam resin material disposed within said cells and extending to said open ends, a reinforcing sheet having a plurality of openings and disposed on at least one of said faces, a plurality of generally cylindrical holes extending through said core between said faces and intersecting said cells, said holes cutting through the walls of said cells, and an elastomeric resin molded around the core and bonded to said faces and said edges and to said material exposed in the open ends of said cells, said elastomeric resin extending through said holes.

10. A method of fabricating an industrial door, comprising the steps of forming a thermoplastic resin honeycomb core composed of a pair of opposed faces connected by side edges, said core having a multiplicity of cells with each cell having an open end and a closed bottom, the open ends of a first group of said cells being located on one of said faces and the open ends of a second group of said cells being located on said opposite face, introducing a lightweight resilient material into said cells to fill the cells to said open ends, and encapsulating said core in an impact resistant thermoplastic resin to enclose said faces and said side edges in said resin.

11. The method of claim 10, and including the step of forming an inwardly extending lip at the open end of each cell.

12. The method of claim 10, and including the step of roughening the material exposed at said open ends before encapsulating said core.

13. The method of claim 10, and including the steps of forming a plurality of holes through said core after said cells are filled with said material, and filling said holes with said resin.

14. The method of claim 10, and including the steps of applying a sheet of foraminous material having a plurality of openings generally flatwise to at least one of said faces before encapsulating said core, and penetrating said thermoplastic resin into said openings during said encapsulating.

15. The method of claim 10, and including the step of forming an outwardly extending wiper strip on at least one side edge of said core during said encapsulating.

16. An industrial door, comprising a honeycomb core formed of thermoplastic resin and having a pair of exposed faces and having side edges connecting said faces, said core composed of a multiplicity of cells with each cell having an open end and a closed bottom, the open ends of a first group of said cells being located on one of said faces while the open ends of a second group of said cells being located on said opposite face, a lightweight resilient flexible material bonded with and filling the cells and extending to said open ends, a tough impact resistant plastic material molded around said core and being bonded to said face and to said side edges and to said material exposed at the open ends of said cells, and a flexible wiper strip integrally molded with said plastic material and extending laterally from at least one of said side edges.

* * * * *